US010231040B2

(12) United States Patent
Lin

(10) Patent No.: US 10,231,040 B2
(45) Date of Patent: Mar. 12, 2019

(54) SPEAKER

(71) Applicant: Hsiu-Ping Lin, New Taipei (TW)

(72) Inventor: Hsiu-Ping Lin, New Taipei (TW)

( * ) Notice: Subject to any disclaimer, the term of this patent is extended or adjusted under 35 U.S.C. 154(b) by 0 days.

(21) Appl. No.: 15/489,751

(22) Filed: Apr. 18, 2017

(65) Prior Publication Data

US 2017/0303023 A1 Oct. 19, 2017

(30) Foreign Application Priority Data

Apr. 18, 2016 (TW) ..... 105112060 A

(51) Int. Cl.
*H04R 1/02* (2006.01)
*H04R 3/12* (2006.01)
*H04R 1/24* (2006.01)

(52) U.S. Cl.
CPC ..... *H04R 1/025* (2013.01); *H04R 1/02* (2013.01); *H04R 3/12* (2013.01); *H04R 1/24* (2013.01); *H04R 2201/029* (2013.01)

(58) Field of Classification Search
CPC . H04R 1/025; H04R 1/24; H04R 3/12; H04R 1/02; H04R 2201/02
USPC ..... 381/335
See application file for complete search history.

(56) References Cited

FOREIGN PATENT DOCUMENTS

| | | |
|---|---|---|
| CN | 204206391 | 3/2015 |
| CN | 103302707 | 10/2015 |

*Primary Examiner* — David Ton

(57) ABSTRACT

A speaker is provided. The speaker includes a supporting shell, at least one first speaker monomer and a waxy material. The supporting shell includes at least one first sound port. The first speaker monomer is installed at the first sound port. The outer surface of the supporting shell is covered by the waxy material. Wherein an average thickness of the waxy material is more than or equal to an average thickness of the supporting shell.

14 Claims, 6 Drawing Sheets

SPEAKER

BACKGROUND OF THE INVENTION

Field of the Invention

The present invention relates to a speaker, more particularly to the speaker using waxy material as a shell of that.

Description of Related Art

In the purchase of speakers, I usually hear such a description, "This speaker with the wooden material, the sound is fuller and pure." Thus, compared to a speaker with the plastic material or the metal material, a speaker with the wooden material has a certain advantage in the sound, because the speaker with wooden material includes the following two advantages:

1. large density value: a shell of most of the wooden speakers is a medium density fiberboard. The density of the medium density fiberboard is uniform and its surface is smooth. Thus, the density value of the shell of the wooden speaker is usually large. Therefore, when a sound is spoken from the wooden speaker, the vibration of the wooden speaker is slight. In this way, the sound from the wooden speaker can be made more real.

2. Excellent resonance: the wooden material is also superior to the plastic material in the reflection of the sound and the resonance of the sound, and the closed effect of the wooden speaker is also very good. In this way, a strong sound signal can be displayed through the air vibration inside the wooden speaker. Furthermore, if the shell of the wooden speaker includes a bigger thickness, the effect of the heavy bass is better.

However, using the speaker with the wooden material still has the following disadvantages:

1. The appearance of the low-cost wooden speaker is poor, and its shell includes a thin thickness. Thus, the low-cost wooden speaker would destroy visual feeling of the indoor environment and it could not speak a good sound.

2. The changeability of the wooden material is poor, so the shape of most of the wooden speakers are cuboid. As a result, the shape of the wooden speakers is monotonous. Furthermore, the manufacturing process of the wooden speaker is slow. When the wooden speaker is manufactured to a certain stage, its shape is not easy to be modified.

Therefore, how to improve the above mentioned and maintain the advantages of the large density value and the excellent resonance, is worthy to be considered by the person having ordinary skill in the art.

SUMMARY OF THE INVENTION

A speaker is provided. The sound of the speaker includes an excellent resonance, and the appearance of the speaker is gorgeous. Moreover, the changeability of the shell of the speaker is nice, and the manufacturing process of the shell is quickly.

A speaker is provided. The speaker includes a supporting shell, at least one first speaker monomer and a waxy material. The supporting shell includes at least one first sound output opening. The first speaker monomer is disposed at the first sound output opening. An external surface of the supporting shell is covered by the waxy material. An average thickness of the waxy material is more than or equal to an average thickness of the supporting shell.

A speaker is provided. The speaker includes a supporting shell, at least one first speaker monomer and a waxy material. The supporting shell includes an outer wall layer, an inner wall layer and at least one first sound output opening. An accommodation space is between the outer wall layer and the inner wall layer. The first speaker monomer is disposed at the first sound output opening. The accommodation space filled up with the waxy material. An average thickness of the waxy material is more than an average thickness of the inner wall layer.

In the speaker, the supporting shell includes four second sound output opening, and the four second sound output opening are each distributed in the four directions of the supporting shell in pairs.

In the speaker, further comprising four second speaker monomers, the four second speaker monomer is respectively disposed at the four second sound output opening.

In the speaker, further comprising a sound source circuit, the sound source circuit is electrically connected to the first speaker monomer and the second speaker monomer.

In the speaker, the second speaker monomer is a mid-range monomer.

In the speaker, wherein the density value of the waxy material is 0.8 $g/cm^3$~0.7 $g/cm^3$.

In the speaker, the first speaker monomer is a bass monomer or a subwoofer.

The foregoing, as well as additional objects, features and advantages of the invention will be more readily apparent from the following detailed description, which proceeds with reference to the accompanying drawings.

DETAILED DESCRIPTION OF THE INVENTION

Figure 1:
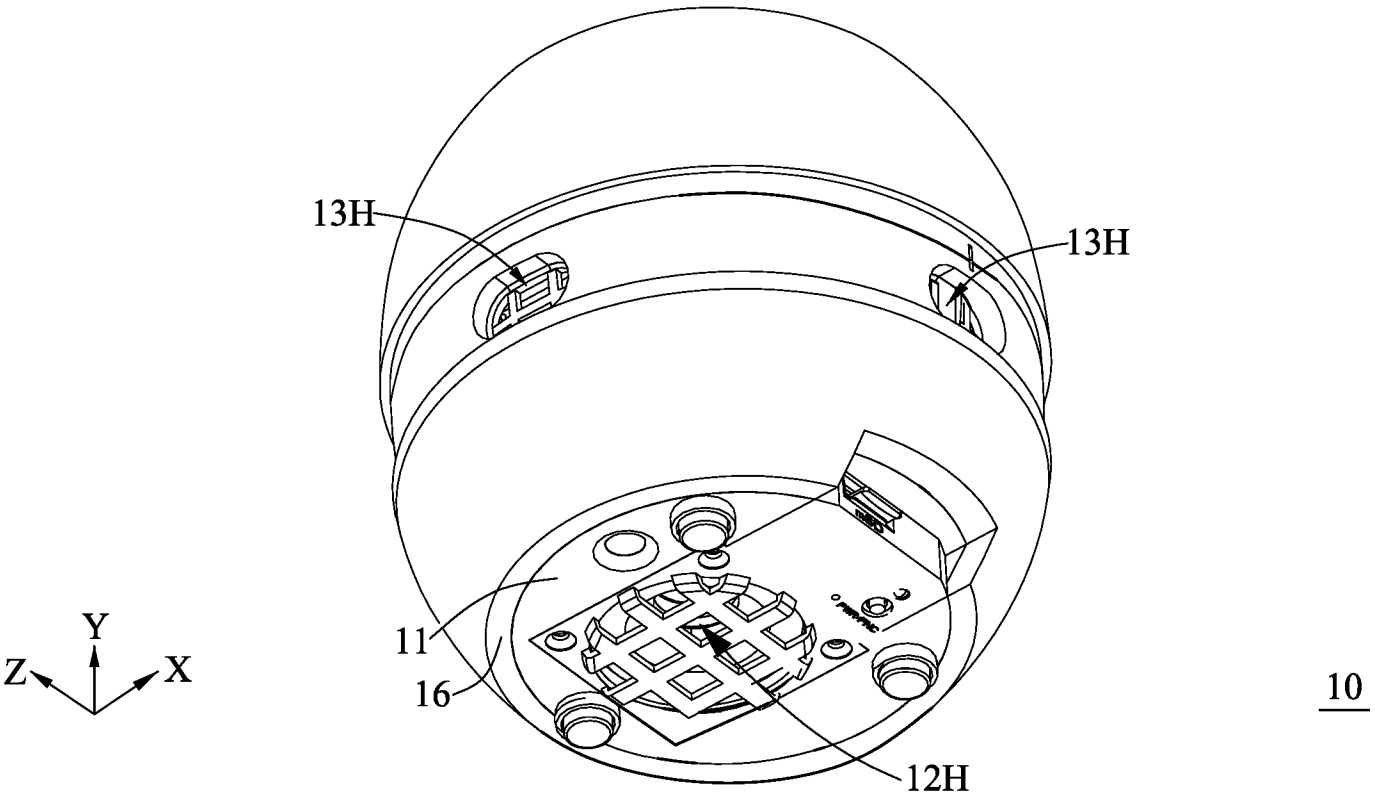
FIG. 1 illustrates a stereogram diagram of a speaker 10 in accordance with an embodiment of the present invention.
Figure 2:
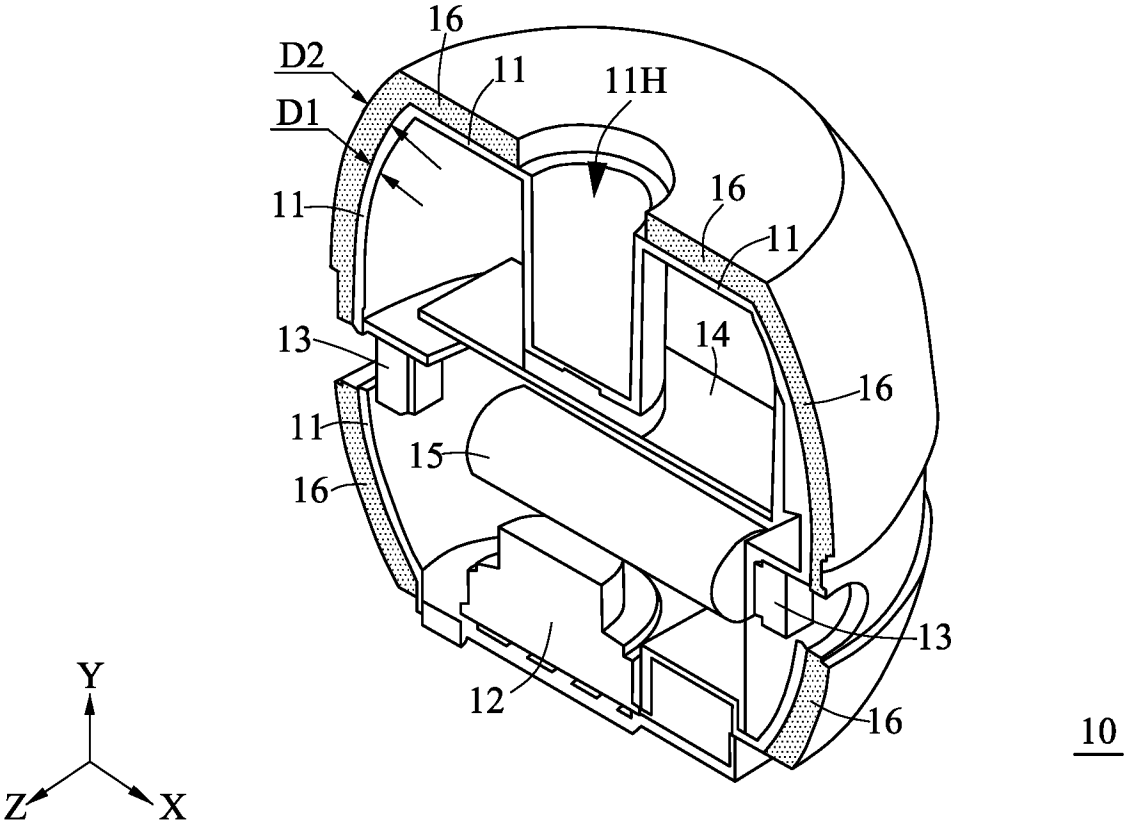
FIG. 2 illustrates a cross section of the Z axis direction of the speaker 10.

Please refer to FIG. 1 and FIG. 2. FIG. 1 illustrates a stereogram diagram of a speaker 10 in accordance with an embodiment of the present invention. FIG. 2 illustrates a cross section of the Z axis direction of the speaker 10. The speaker 10 includes a supporting shell 11, a first speaker monomer 12, four second speaker monomers 13, a sound source circuit 14, a battery module 15 and a waxy material 16. The supporting shell 11 is a spherical hollow shell. The first speaker monomer 12, the second speaker monomer 13, the sound source circuit 14 and the battery module 15 are all disposed inside the supporting shell 11. Furthermore, the supporting shell 11 includes at least one first sound output opening 12H (In the present invention, the first sound output opening 12H is disposed under the supporting shell 11.) and four second sound output opening 13H. The four second sound output opening 13H are each distributed in the four directions of the supporting shell. The four second sound output opening 13H are divided into two groups. The second sound output openings 13H of each group look at each other.

Figure 3:
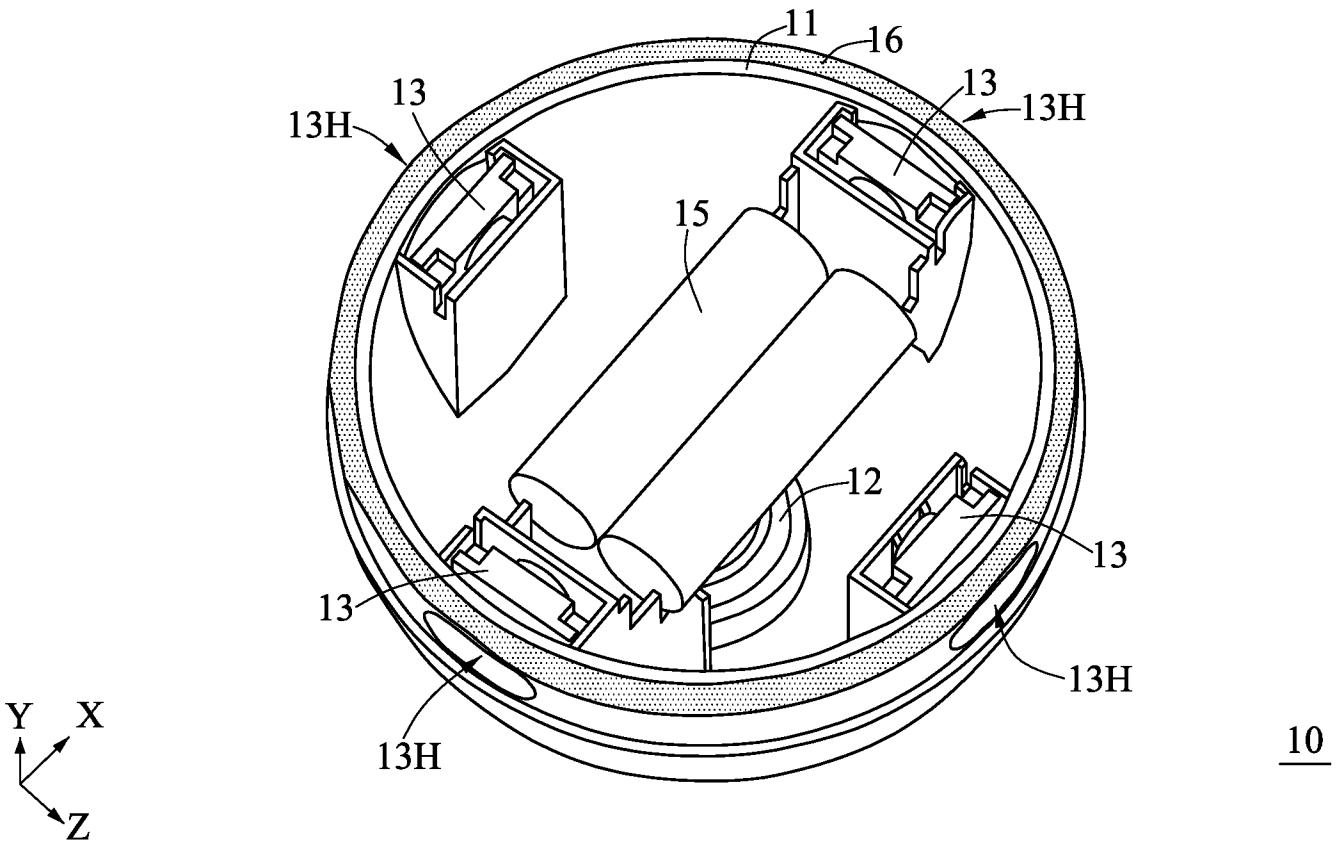
FIG. 3 illustrates a cross section of the Y axis direction of the speaker 10.
Figure 4:
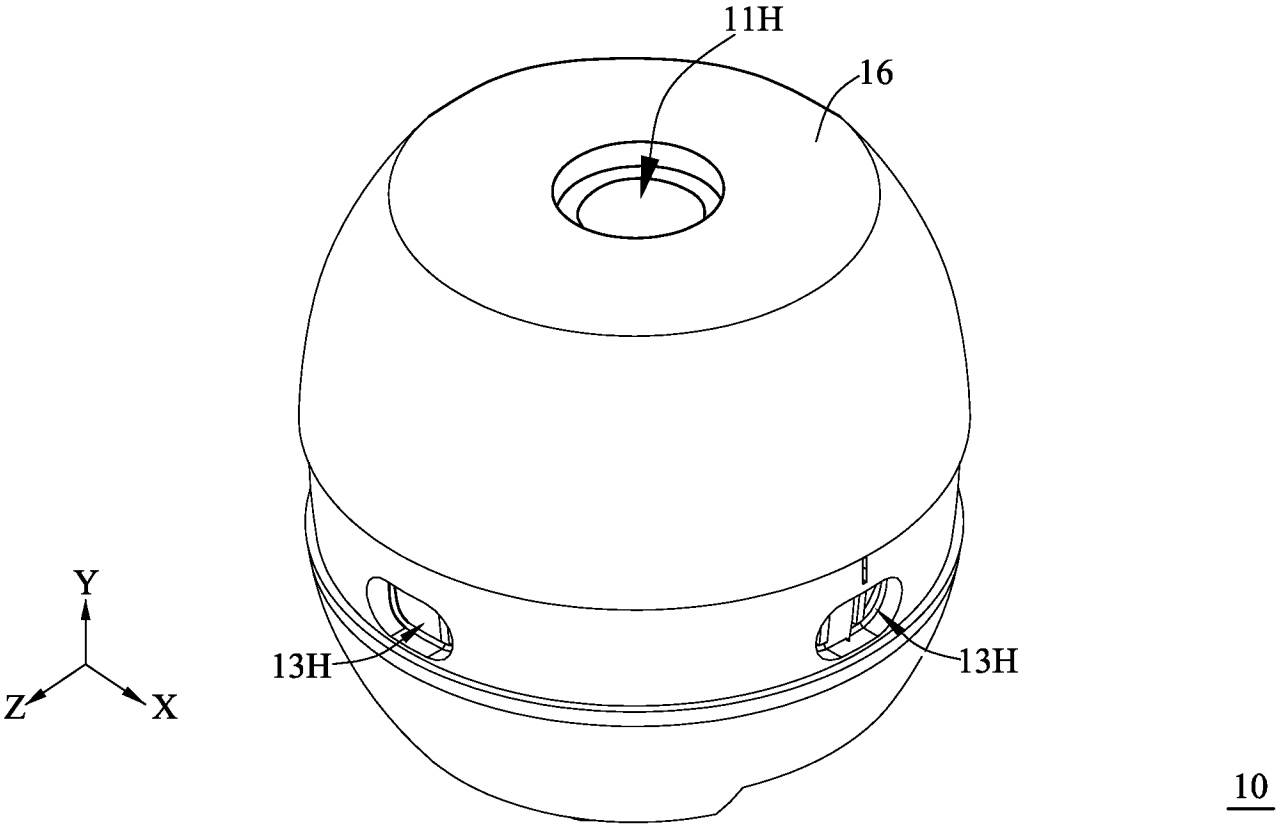
FIG. 4 illustrates a stereogram diagram of another direction of the speaker 10.

Please refer to FIG. 2 and FIG. 3. FIG. 3 illustrates a cross section of the Y axis direction of the speaker 10. The first speaker monomer 12 is disposed at the first sound output opening 12H. For example, the first speaker monomer 12 is a bass monomer or a subwoofer. The four second speaker monomer is respectively disposed at the four second sound output opening. For example, the second speaker monomer is a mid-range monomer. Moreover, the sound source circuit 14 is configured to receive an external sound signal. The sound source circuit 14 is electrically connected to the first speaker monomer 12 and the second speaker monomer 12 to transmit the external sound signal into the first speaker monomer 12 and the second speaker monomer 13. The battery module 15 is electrically connected to the sound source circuit 14 to power the sound source circuit 14. In addition, the supporting shell 11 further includes a cylindrical groove 11H (Please refer to FIG. 4, and FIG. 4 illustrates a stereogram diagram of another direction of the speaker 10.). A cylindrical electronic candle is suitable to be embedded in the groove 11H, and the candlelight of the electronic candle is produced by using a LED lamp projected on a paper. The density value of the waxy material 16 is 0.8 $g/cm^3$~0.7 $g/cm^3$, and the waxy material 16 belongs to a high density wax with proper strength. An external surface of the supporting shell 11 is covered by the waxy material 16, and an average thickness of the waxy material 16 is more than or equal to an average thickness of the supporting shell 11. Specifically, please refer to FIG. 2 again. If the average thickness of the supporting shell 11 is D1 and the average thickness of the waxy material 16 is D2, the D2 must be more than or equal to the D1. Therefore, it could be said the main shell structure of the speaker 10 is constituted by the waxy material 16. Furthermore, the density value of the waxy material 16 is large. Thus, when a sound is spoken from the first speaker monomer 12 or the second speaker monomer 13, the vibration of the speaker 10 is slight. Compared to the common wooden material, the waxy material 16 in the reflection and the resonance of the sound is also excellent, and it could increase the closed effect of the speaker 10. Therefore, the sound spoken from the first speaker monomer 12 and the second speaker monomer 13 is excellent. In addition, compared to the changeability of the wooden material, the changeability of the waxy material 16 is great, and the manufacturing process of the shell of the waxy material 16 is quickly. When the speaker 10 is manufactured to a certain stage, its shape is easy to be modified. Therefore, the shape and the color of the speaker 10 could produce a variety of assorted designs via the waxy material 16, and its shape and color could be modified according to the needs of users. For example, the user could stamp his name or any texts on the waxy material 16. In the above, if the electronic candle is embedded in the groove 11H and the gorgeous waxy material 16 covers the supporting shell 11, the speaker 10 would look like a real candle.

Figure 5:
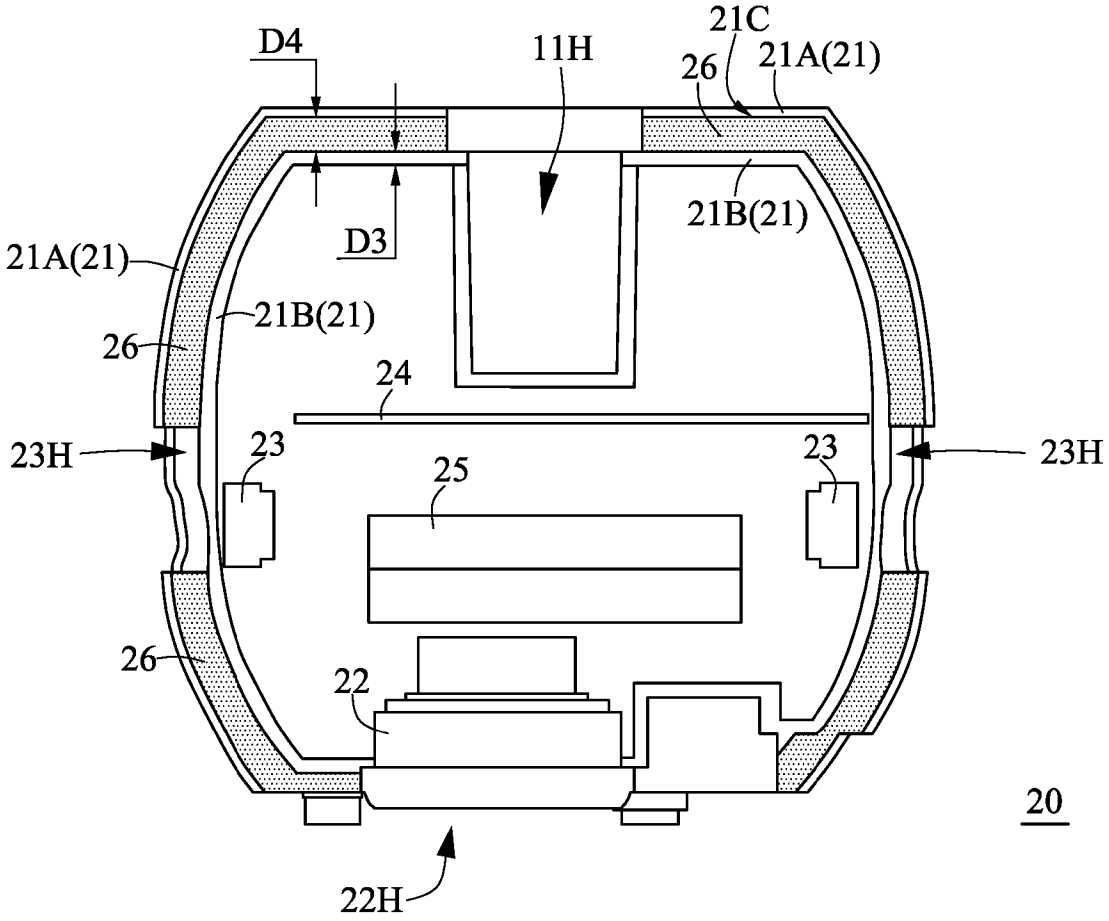
FIG. 5 illustrates a cross-sectional view of a speaker 20 in accordance with another embodiment of the present invention.

Please refer to FIG. 5. FIG. 5 illustrates a cross-sectional view of a speaker 20 in accordance with another embodiment of the present invention. The speaker 20 is evolved via the speaker 10. The speaker 20 includes a supporting shell 21, a first speaker monomer 22, four second speaker monomer 23, a sound source circuit 24, a battery module 25 and a waxy material 26. The supporting shell 21 include a first sound output opening 22H and four second sound output opening 23H. However, the difference between the speaker 20 and the speaker 10 is the supporting shell 21 includes an outer wall layer 21A and an inner wall layer 21B. An accommodation space 21C is between the outer wall layer 21A and the inner wall layer 21B. The accommodation space 21C filled up with the waxy material 26. An average thickness of the waxy material 26 is more than an average thickness of the inner wall layer 21B. Specifically, if the average thickness of the inner wall layer 21B is D3 and the average thickness of the waxy material 26 is D4, the D4 must be more than the D3. Therefore, when a sound is spoken from the first speaker monomer 22 and the second speaker monomer 23, the waxy material 26 makes the vibration of the speaker 20 is slight. The waxy material 26 in the reflection and the resonance of the sound is also excellent, and it could increase the closed effect of the speaker 20. Therefore, the sound spoken from the first speaker monomer 22 and the second speaker monomer 23 is excellent.

Figure 6:
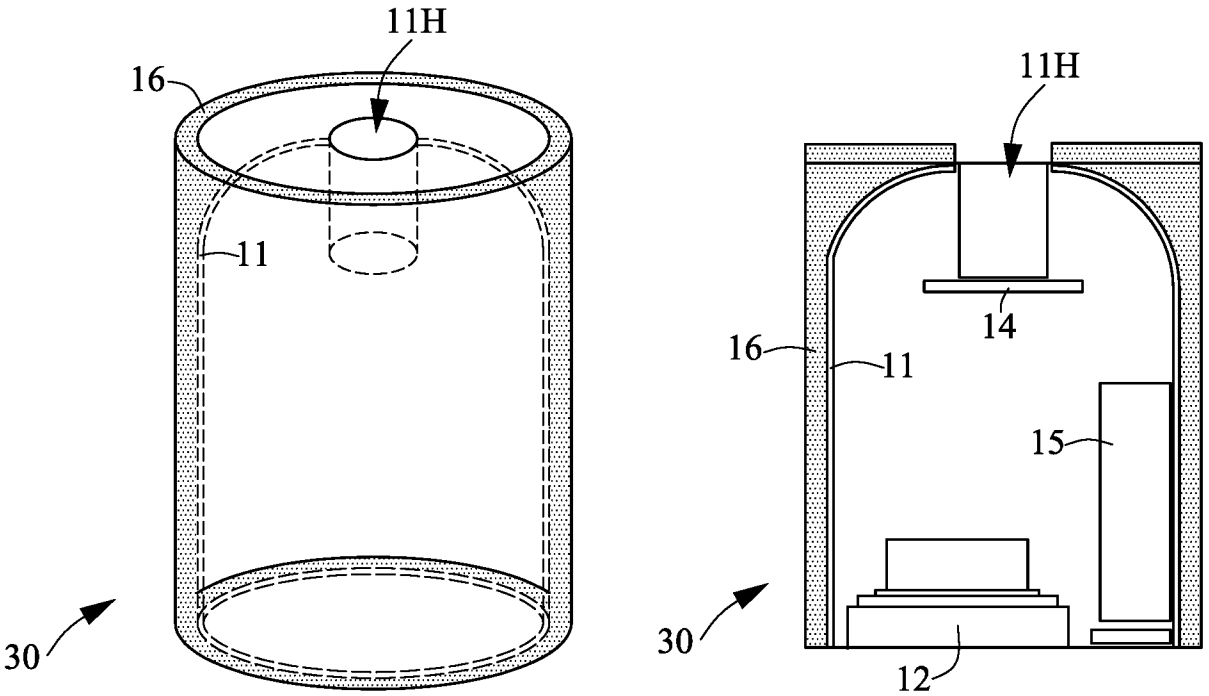
FIG. 6 illustrates a stereogram diagram and a cross-sectional view of a speaker 30.

Please refer to FIG. 6. FIG. 6 illustrates a stereogram diagram and a cross-sectional view of a speaker 30. The difference between the speaker 30 and the speaker 10 is the appearance of the speaker 30 is cylindrical. Thus, the speaker 30 would be more like a real candle.

In summary, the speaker 10 and the speaker 20 include the following advantages (The speaker 20 does not include the second advantage.):

1. "the waxy material with proper strength" is used to be a main shell of the speaker in order that the speaker has an excellent resonance. Moreover, the speaker with the waxy material looks like a real candle, so it would reveal a high texture of the state. In short, the speaker of the present invention has become a boutique.

2. The changeability of the waxy material is great, and the manufacturing process of the shell of the waxy material 16 is quickly. When the speaker is manufactured to a certain stage, its shape is easy to be modified. Therefore, the shape and the color of the speaker 10 could produce a variety of assorted designs, and its shape and color could be modified according to the needs of users.

Although the description above contains many specifics, these are merely provided to illustrate the invention and should not be construed as limitations of the invention's scope. Thus it will be apparent to those skilled in the art that various modifications and variations can be made in the system and processes of the present invention without departing from the spirit or scope of the invention.

What is claimed is:

1. A speaker comprising:

a supporting shell includes at least one first sound output opening;

at least one first speaker monomer is disposed at the first sound output opening;

a waxy material, an external surface of the supporting shell is covered by the waxy material, and the waxy material belongs to a high-density wax;

wherein an average thickness of the waxy material is more than or equal to an average thickness of the supporting shell.

2. The speaker of claim 1, wherein the supporting shell includes four second sound output opening, and the four second sound output opening are each distributed in the four directions of the supporting shell in pairs.

3. The speaker of claim 2, further comprising four second speaker monomers, the four second speaker monomer is respectively disposed at the four second sound output opening.

4. The speaker of claim 3, further comprising a sound source circuit, the sound source circuit is electrically connected to the first speaker monomer and the second speaker monomer.

5. The speaker of claim 3, wherein the second speaker monomer is a mid-range monomer.

6. The speaker of claim 1, wherein the density value of the waxy material is 0.8 $g/cm^3$~0.7 $g/cm^3$.

7. The speaker of claim 1, wherein the first speaker monomer is a bass monomer or a subwoofer.

8. A speaker comprising:

a supporting shell includes an outer wall layer, an inner wall layer and at least one first sound output opening, and an accommodation space is between the outer wall layer and the inner wall layer;

at least one first speaker monomer is disposed at the first sound output opening;

a waxy material, the accommodation space filled up with the waxy material, and the waxy material belongs to a high-density wax;

wherein an average thickness of the waxy material is more than an average thickness of the inner wall layer.

9. The speaker of claim 8, wherein the supporting shell includes four second sound output opening, and the four second sound output opening are each distributed in the four directions of the supporting shell in pairs.

10. The speaker of claim 9, further comprising four second speaker monomers, the four second speaker monomer is respectively disposed at the four second sound output opening.

11. The speaker of claim 10, further comprising a sound source circuit, the sound source circuit is electrically connected to the first speaker monomer and the second speaker monomer.

12. The speaker of claim 10, wherein the second speaker monomer is a mid-range monomer.

13. The speaker of claim 8, wherein the density value of the waxy material is 0.8 $g/cm^3$~0.7 $g/cm^3$.

14. The speaker of claim 8, wherein the first speaker monomer is a bass monomer or a subwoofer.

* * * * *